US008708130B2

(12) United States Patent
De Coi et al.

(10) Patent No.: US 8,708,130 B2
(45) Date of Patent: Apr. 29, 2014

(54) START-UP SENSOR WITH ENTRANCE WAY MONITORING FOR ESCALATORS OR MOVING WALKWAYS

(71) Applicant: Cedes AG, Landquart (CH)

(72) Inventors: Beat De Coi, Sargans (CH); Tobias Leutenegger, Chur (CH)

(73) Assignee: Cedes AG, Landquart (CH)

( * ) Notice: Subject to any disclaimer, the term of this patent is extended or adjusted under 35 U.S.C. 154(b) by 0 days.

(21) Appl. No.: 13/716,451

(22) Filed: Dec. 17, 2012

(65) Prior Publication Data

US 2014/0076686 A1 Mar. 20, 2014

(30) Foreign Application Priority Data

Sep. 18, 2012 (EP) ..... 12006538

(51) Int. Cl.
*B66B 25/00* (2006.01)

(52) U.S. Cl.
USPC ..... 198/322

(58) Field of Classification Search
USPC ..... 198/322
See application file for complete search history.

(56) References Cited

U.S. PATENT DOCUMENTS

| | | | | |
|---|---|---|---|---|
| 1,985,563 | A * | 12/1934 | Fitz Gerald | 198/322 |
| 5,992,604 | A * | 11/1999 | Buescher et al. | 198/322 |
| 6,334,522 | B2 * | 1/2002 | Haruta et al. | 198/322 |
| 6,988,607 | B2 * | 1/2006 | Blondiau et al. | 198/322 |

FOREIGN PATENT DOCUMENTS

| | | | |
|---|---|---|---|
| JP | 2007-314294 | A1 | 12/2007 |
| JP | 2009-249077 | A1 | 10/2009 |
| JP | 2011-011874 | A1 | 1/2011 |

OTHER PUBLICATIONS

European Search Report dated Feb. 21, 2013.

* cited by examiner

*Primary Examiner* — James R Bidwell
(74) *Attorney, Agent, or Firm* — Burr & Brown, PLLC

(57) ABSTRACT

A moving device including a driven conveyor, a control device for controlling the speed of the conveyor and a start-up sensor, which monitors a monitoring region in front of the moving device and outputs a start-up signal to the control device upon detecting an object, wherein, upon a provided start-up signal, the control device sets into motion or accelerates the moving device. The start-up sensor is a TOF sensor having (i) a light source for emitting modulated light, (ii) at least one receiving sensor for receiving light from the light source that is reflected at the object, and (iii) an evaluation electronic system configured for detecting, from the comparison of emitted and received light, the distance of the object from the TOF sensor and the position of the object in the space in front of the moving device.

17 Claims, 3 Drawing Sheets

START-UP SENSOR WITH ENTRANCE WAY MONITORING FOR ESCALATORS OR MOVING WALKWAYS

This application claims the benefit under 35 USC §119(a)-(d) of European Application No. 12 006 536.8 filed Sep. 18, 2012, the entirety of which is incorporated herein by reference.

FIELD OF THE INVENTION

The invention relates to a start-up sensor with entrance way monitoring for escalators and moving walkways and to an escalator or a moving walkway having such a start-up sensor.

BACKGROUND OF THE INVENTION

Step contact mats or light barriers in front of escalators or moving walkways that trigger their start-up are known from the prior art.

Typically, escalators and moving walkways are stopped or slowed if they have not been used for a specific time period. Furthermore, the moving devices, which were previously stopped or slowed, start up accordingly before or as soon as a person steps onto the moving device.

SUMMARY OF THE INVENTION

It is the object of the invention to enable improved start-up.

Escalators or moving walkways will be referred to as moving devices below.

The moving device according to the invention is a moving device having a driven conveying means and having a control device for controlling the speed of the conveying means and having a start-up sensor, which monitors a monitoring region in front of the moving device and outputs a start-up signal to the control device upon capturing an object, wherein the control device, upon a provided start-up signal, starts up or accelerates a stopped or slowed moving device and wherein the start-up sensor is a TOF sensor having a light source for emitting modulated light, having at least one receiving sensor for receiving light from the light source that is reflected at an object, wherein the one receiving sensor or the receiving sensors are arranged with a predetermined spatial relationship with respect to the light source, and having an evaluation electronic system configured for detecting, from the comparison of emitted and received light, the distance of the object from the TOF sensor and the position of the object in the space in front of the moving device.

This can have the advantage that the moving device can be controlled in dependence on a clearly definable distance or distance regions, wherein the start-up sensor can be placed at a distance from the trigger distance.

Escalators are person-conveying means to overcome a height distance, in which moving elements form steps. Escalators are sometimes also referred to as moving staircases. Moving walkways are person-conveying means analogous to an escalator for overcoming a displacement distance and possibly also a height distance, the transport surface of which substantially forms a surface. The surface can be made up of moving elements or of moving belts. Moving walkways are sometimes also referred to as moving pavement or belt conveyor. Escalators and moving walkways can also transition into one another in a section-wise manner in the same moving device. The driven conveying means forms the moving elements or the transport surface.

Moving devices typically comprise in the conveying direction, on both sides next to the steps, the moving elements or the moving belts, what are referred to as moving handrails, which have belts that move concurrently in a circulatory manner. The foot of the moving handrail is in particular the part of the moving device that is located at the end of the moving handrail between moving handrail and ground. In particular, the belt of the moving handrail emerges from or disappears into the moving handrail directly above the foot.

The monitoring region can be the access region, that is to say the region from which it may be assumed that a person who is situated therein wishes to use the moving device. The term "in front of the moving device" is to be viewed from the point of view of the potential user, with the result that both ends of a moving device might be referred to. The object can be a person or an item. Light can be visible or non-visible light. Preferably infrared light (IR) is used. This has the advantage that it cannot disturb people since it is invisible to the human eye.

Accordingly, the receiving sensors of the TOF sensor are sensitive to the light used, e.g. IR-sensitive. The light emitted from the light source is preferably concentrated substantially on the monitoring region so as to increase efficiency. The receiving sensors are located with a predetermined spatial relationship with respect to the light source, in particular with a fixed spatial relationship. The receiving sensors are expediently arranged in spatial proximity to the light source, in particular in the same apparatus, in particular in the same housing. This simplifies evaluation and makes the start-up sensor more compact. The modulation of the light is preferably a modulation of the intensity with a frequency of 20 MHz. The distance of an object is preferably obtained by an analysis of the phase shift between the emitted light and the light that is reflected at an object and received by the TOF sensor. The TOF sensor preferably resolves the position of the object according to the number of its receiving sensors. It is conceivable that an average value is formed over a given number of receiving sensors. The TOF sensor substantially has no moving parts and therefore requires little maintenance.

The evaluation electronic system evaluates the TOF sensor and calculates the distance information and/or the location information and/or the movement direction information and/or the speed information and/or the intensity image information, and forms the boundaries of the monitoring region by selectively screening off distances outside the monitoring region. This evaluation and/or calculation could in part also be carried out by the control device. The location information can be obtained by linking the distance information with the imaging of the scenery on the receiving sensors. The movement direction information and/or the speed information can be obtained by time-resolved evaluation of the location information. The evaluation electronic system can be configured to be settable, such that boundaries of the monitoring region can be changed using setting apparatuses. Setting apparatuses can be setting elements on the start-up sensor or on the control device or on a wireless setting apparatus.

The TOF sensor is preferably a line-scan sensor or a matrix sensor. The TOF sensor preferably has a plurality of receiving sensors, which are arranged and/or configured as line-scan sensor and/or as matrix sensor. The line-scan sensor can monitor a plane using a corresponding optical system. The TOF line-scan sensor and its optical system can be aligned parallel to the ground and thus monitor a plane parallel to the ground by imaging the environment onto the line-scan sensor in a fan-like manner and thus producing a distance image and possibly also an intensity image of the plane. The TOF matrix sensor can be configured for the 3D representation of the monitoring region. By way of an appropriate optical system, the matrix sensor can also be provided for monitoring only a single plane by imaging a plane section of the environment onto the sensor and/or evaluating a plane section of the environment using software. The TOF sensors can additionally also capture an intensity image of the environment, if appropriate. When using in particular a single individual sensor, the monitoring region can also be formed using only one optical system so as to save costs.

The TOF sensor is preferably arranged in the plane of a moving handrail of the moving device. The plane of the moving handrail is substantially the plane that is formed by the circulating belt. The plane has, analogously to a plate, a thickness that is centered with respect to the moving handrail and corresponds to three times the thickness, in particular to the thickness, of the moving handrail. As a result, the TOF sensor can be integrated for example in posts or railings on the moving device that are present already, is hardly noticeable and is arranged in a space-saving manner.

The horizontal monitoring region is the plan view of the monitoring region, that is to say its perpendicular projection onto the ground. The horizontal monitoring region of the TOF sensor is preferably aligned in continuation of the moving device and has a width comparable to the conveying means or the moving device. This has the advantage that the monitoring region can be formed analogously to the monitoring region of known step contact mats. This has the additional advantage that the monitoring region is concentrated on the most relevant region in front of the moving device. Forming the monitoring region as suggested here is possible with the TOF sensor so advantageously because the for example fan-like environment image of the TOF sensor can be very easily limited to the desired monitoring region in the evaluation.

The horizontal monitoring region preferably tapers with increasing distance from the moving device. This has the advantage that people who do not wish to step onto the moving device and instead walk very closely past the monitoring region laterally along the moving device counter to the direction of access to the moving device are not captured. This is the case, for example, when two moving devices for opposite directions are arranged next to each other such that people who for example leave one moving device are tangent to the access region to the other moving device. By limiting the monitoring region, incorrect interpretations are thus avoided.

The TOF sensor is preferably arranged below the upper layer of the moving handrail of the moving device, in particular below 100 cm above the ground, preferably between 40 cm and 20 cm above the ground, particularly preferably between 30 and 10 cm above the ground, particularly preferably between 20 cm and 5 cm above the ground, particularly preferably below 10 cm above the ground, and furthermore in particular in the foot of the moving handrail or in a column in front of the moving device. This can have the advantage that the TOF sensor can be positioned very inconspicuously and is protected against damage.

The column can be arranged in continuation of the moving handrail in particular at a distance in front of the moving device. In particular, the column can also be positioned centrally between 2 parallel adjacent escalators in particular at a distance in front of them. The column can thus also serve to guide the user. The column can also be part of a moving handrail in the direction of the moving device.

The monitoring region preferably extends parallel to the ground. Parallel can here preferably also mean substantially parallel, that is to say widening approximately vertically in a slightly fan-like manner with a parallel central plane. Parallel can particularly preferably mean that at least one expansion plane of a monitoring region, which widens vertically in a slightly fan-like manner, extends parallel to the ground. Slightly fan-like here means with an opening angle of less than 20°, in particular less than 10°, particularly preferably less than 5°, particularly preferably less than 2°. This has the advantage that a uniform evaluation of the access region and, if appropriate, of its environment can be carried out.

The monitoring region preferably adjoins the ground. This has the advantage that even very low objects, such as the supports of an open-front baggage transport trolley or animals, can be detected.

It is conceivable that with very low objects the control device initiates a different reaction of the moving device than with higher objects. The control device could, in dependence on the height or size of the detected object, initiate different measures. By way of example, the control device could, in the case of a very small object such as an animal, brake the moving device or stop it.

A start-up signal is preferably output only when the object moves towards the moving device, in particular when the object moves at an angle of less than a specific angle with respect to the longitudinal axis of the moving device, preferably when the angle is less than 90° with respect to the longitudinal axis of the moving device, particularly preferably when the object moves across a perimeter around the start of the moving device from outside the perimeter to the inside. It is assumed that people entering the access region but moving perpendicular to the moving device or away from it do not wish to use the moving device. This can have the advantage that the moving device does not start up for no reason, and thus saves energy and reduces wear.

The control device preferably regulates the acceleration of the moving device in dependence on the distance of the object from the start-up sensor or from the moving device. This can have the advantage that the moving device could be accelerated slowly and thus economically advantageously if a person is still far away, while the moving device could be accelerated quickly if a person is already very close, so as to increase the certainty that the moving device already has the desired speed when the person steps on.

The control device preferably regulates the acceleration of the moving device in dependence on the speed of the object. This has the advantage that the moving device could be accelerated slowly and thus economically advantageously if a person approaches slowly, while the moving device could be accelerated quickly if a person approaches quickly, so as to increase the certainty that the moving device already has the desired speed when the person steps on.

The start-up sensor according to the invention is a start-up sensor as described above for use with a moving device as described above for monitoring a monitoring region in front of the moving device and for outputting a start-up signal to the controller of the moving device upon capturing of an object, wherein the start-up sensor is a TOF sensor having a light source for emitting modulated light, having at least one receiving sensor for receiving light from the light source that is reflected at an object, wherein the receiving sensors are arranged with a predetermined spatial relationship with respect to the light source, and having an evaluation electronic system configured for detecting, from the comparison of emitted and received light, the distance of the object from the TOF sensor and the position of the object in the space in front of the moving device.

The control device according to the invention is a control device as described above for use with a moving device as described above.

This can have the advantage that the start-up sensor and/or the control device is retrofittable and/or can be maintained or exchanged as a separate unit.

Further features of the invention are given in the drawings.

The respectively mentioned advantages can also apply to feature combinations, in connection with which they are not mentioned.

BRIEF DESCRIPTION OF THE DRAWINGS

Exemplary embodiments of the invention are illustrated in the drawings and will be explained in further detail below. Identical reference signs in the individual figures here designate mutually corresponding elements.

DETAILED DESCRIPTION OF THE INVENTION

Figure 1:
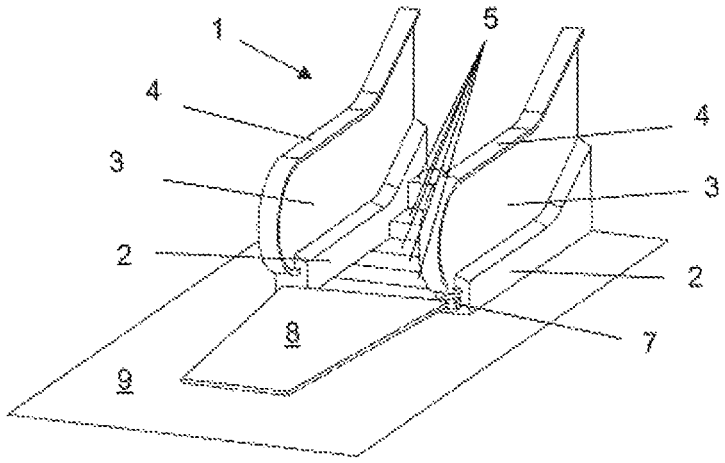
FIG. 1 shows an escalator in 3D view.

FIG. 1 shows an escalator 1 in 3D view. The escalator comprises moving elements 5 for transporting people, which elements form a plane at the height of the surrounding ground 9 in the region in front of the slope of the escalator and form a step form in the region of the slope of the escalator. The escalator furthermore comprises on both sides two feet 2, on which, at least in a start region of the escalator, balustrades 3 are placed on both sides. Arranged around the balustrades are moving handrails 4 as moving ring belts, which in terms of their speed follow the movement of the moving elements 5. The moving handrails penetrate openings of the feet above the ground in order to cycle around the balustrades underneath. Arranged at one foot 2 of the escalator 1, between the opening of the foot for the moving handrail and the ground, is a start-up sensor 7, which forms a monitoring field 8.

Figure 2:
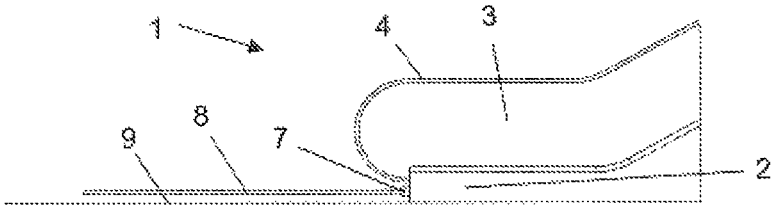
FIG. 2 shows an escalator in side view.

FIG. 2 shows the escalator 1 of FIG. 1 in side view. The start-up sensor 7 is arranged at a distance from the ground 9 and from the moving handrail 4 at the foot 2 in the direction of the access to the escalator. The monitoring field 8 extends with a thickness of approximately 5 cm and a distance of approximately 10 cm parallel to the ground. Conceivable is also a thickness of the monitoring field that increases with increasing distance from the start-up sensor 7 above the ground. Conceivable is also that the monitoring field touches the ground starting at a specific distance from the start-up sensor.

Figure 3:
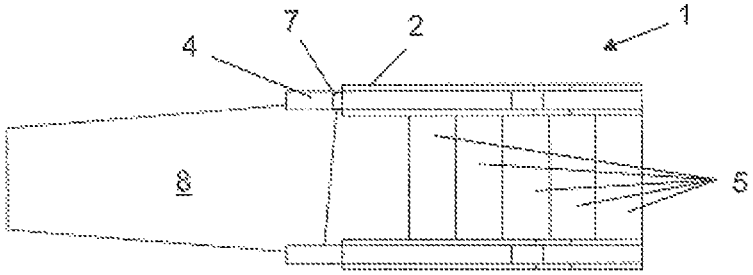
FIG. 3 shows an escalator in plan view.

FIG. 3 shows the escalator 1 of FIG. 1 in plan view. The start-up sensor 7 below the moving handrail 4 is illustrated such that it can be seen for the purposes of better illustration. The monitoring field 8 starts from the start-up sensor 7 and forms a skewed trapezium. In particular, the monitoring field tapers with increasing distance from the escalator.

Figure 4:
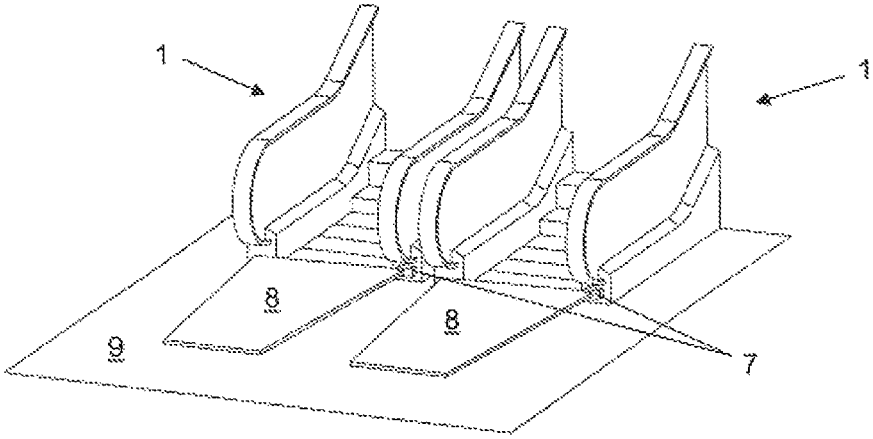
FIG. 4 shows two parallel escalators in 3D view.
Figure 5:
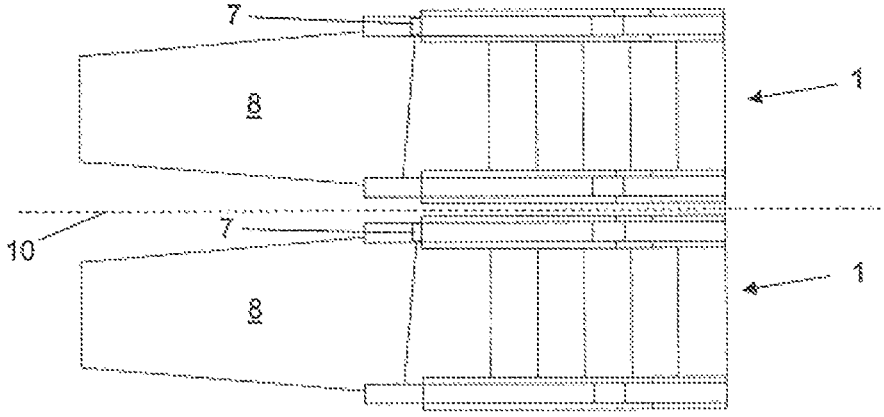
FIG. 5 shows two parallel escalators in plan view.

FIG. 4 shows two parallel escalators 1 of FIG. 1 in 3D view for illustrating FIG. 5.

FIG. 5 shows the two parallel escalators 1 of FIG. 4 in plan view. Each escalator has a start-up sensor 7, which defines in each case one monitoring field 8. The monitoring fields taper with increasing distance from the escalators. In particular, the monitoring regions have, with increasing distance from the respective escalator, an increasing distance from the separation plane 10 between the two escalators. The separation plane 10 is the plane parallel to the plane of the moving handrails or balustrades in the center between the two escalators.

Figure 6:
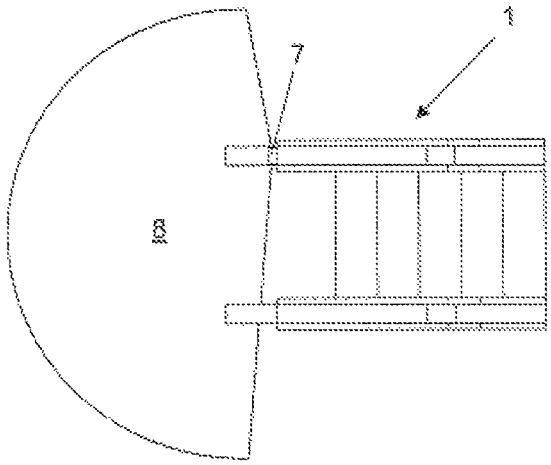
FIG. 6 shows an escalator in plan view.

FIG. 6 shows an escalator 1 of the type of FIG. 1 in plan view. The start-up sensor 7 here defines an arc-shaped monitoring region 8, which forms a perimeter around the entry region of the escalator.

Figure 7:
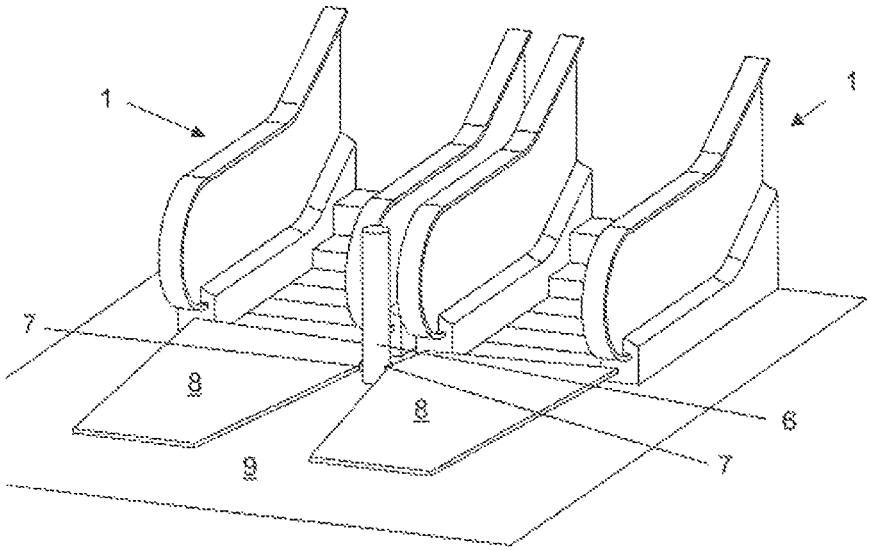
FIG. 7 shows two parallel escalators with central column in 3D view.

FIG. 7 shows two parallel escalators 1 of the type of FIG. 1 with central column 6 in 3D view. The start-up sensor 7 is here not arranged in the feet of the escalators, but at a distance from the escalators in a column approximately 10 cm above the ground, centrally in front of the two escalators. The start-up sensors in each case define a monitoring region, which approximately corresponds to the monitoring region of FIG. 1. The opening angle of the start-up sensor, which is parallel to the ground, is here greater than 90° and is approximately 160°. An opening angle of 90° or less than 90° would be possible if the boundary of the monitoring region in the direction of the escalator were drawn in a line directly to the foot which is arranged further apart.

LIST OF REFERENCE SIGNS

1 moving staircase
2 foot
3 balustrade
4 moving handrail
5 step element
6 column
7 start-up sensor
8 monitoring region
9 ground
10 separation plane

We claim:

1. A moving device comprising:

a driven conveyor;

a control device for controlling the speed of the conveyor;

a start-up sensor, which monitors a monitoring region in front of the moving device and outputs a start-up signal to the control device upon detecting an object, wherein, upon a provided start-up signal, the control device sets into motion or accelerates the moving device, wherein the start-up sensor is a TOF sensor having (i) a light source for emitting modulated light (ii) a plurality of receiving sensors that are configured as at least one of a line-scan sensor and a matrix sensor for receiving light from the light source that is reflected at the object, wherein the plurality of receiving sensors are arranged with a predetermined spatial relationship with respect to the light source, and (iii) an evaluation electronic system configured for detecting, from the comparison of emitted and received light, the distance of the object from the TOF sensor and the position of the object in the space in front of the moving device.

2. The moving device of claim 1, wherein the moving device is an escalator or a moving walkway.

3. The moving device according to claim 1, wherein the TOF sensor is arranged in the plane of a moving handrail of the moving device.

4. The moving device according to claim 1, wherein the start-up sensor is configured such that a horizontal monitoring region has, in continuation of the moving device, the width of the conveyor or of the moving device.

5. The moving device according to claim 1, wherein the start-up sensor is configured such that a horizontal monitoring region extends in continuation of the moving device and tapers with increasing distance.

6. The moving device according to claim 1, wherein the TOF sensor is arranged below the upper layer of a moving handrail of the moving device.

7. The moving device according to claim 6, wherein the TOF sensor is arranged in one of the following positions: (i) below 100 cm above the ground, (ii) between 40 cm and 20 cm above the ground, (iii) between 30 cm and 10 cm above the ground, (iv) between 20 cm and 5 cm above the ground, or (v) below 10 cm above the ground.

8. The moving device according to claim 6, wherein the TOF sensor is arranged in at least one of the foot of a moving handrail of the moving device and in a column in front of the moving device.

9. The moving device according to claim 1, wherein the start-up sensor is configured such that the monitoring region extends parallel to the ground.

10. The moving device according to claim 1, wherein the start-up sensor is configured such that the monitoring region adjoins the ground.

11. The moving device according to claim 1, wherein the start-up sensor is configured such that a start-up signal is output only when the object moves towards the moving device.

12. The moving device according to claim 11, wherein the start-up signal is output only when the object moves at an angle of less than 90° with respect to the longitudinal axis of the moving device.

13. The moving device according to claim 11, wherein the start-up signal is output only when the object moves across a perimeter around the start of the moving device from outside the perimeter to the inside.

14. The moving device according to claim 1, wherein the control device is configured to regulate the acceleration of the moving device depending upon the distance of the object, determined by the start-up sensor, from the start-up sensor or from the moving device.

15. The moving device according to claim 1, wherein the control device is configured to regulate the acceleration of the moving device depending upon the speed of the object with respect to the start-up sensor or to the moving device.

16. A control device for use with a moving device, said control device including the start-up sensor of claim 15.

17. A start-up sensor for monitoring a monitoring region in front of a moving device and for outputting a start-up signal to a controller of the moving device upon detecting an object, the start-up sensor comprising a TOF sensor having (i) a light source for emitting modulated light, (ii) a plurality of receiving sensors that are configured as at least one of a line-scan sensor and a matrix sensor for receiving light from the light source that is reflected at an object, wherein the plurality of receiving sensors are arranged with a predetermined spatial relationship with respect to the light source, and (iii) an evaluation electronic system configured for detecting, from the comparison of emitted and received light, the distance of the object from the TOF sensor and the position of the object in the space in front of the moving device.

* * * * *